US005090354A

United States Patent [19]

Fereretti

[11] Patent Number: 5,090,354

[45] Date of Patent: Feb. 25, 1992

[54] PINSTRIPE PAINTING GUIDE AND METHOD OF USE

[76] Inventor: Raymond M. Fereretti, 13890 SW. 90th Ave., No. HH207, Miami, Fla. 33176

[21] Appl. No.: 520,670

[22] Filed: May 8, 1990

[51] Int. Cl.[5] ..... B05C 11/00

[52] U.S. Cl. ..... 118/505; 118/504; 427/286; 401/193; 264/225

[58] Field of Search ..... 118/504, 505, 207, 305; 428/31; 427/286; 401/193, 48; 264/219, 225, 226, 227

[56] References Cited

U.S. PATENT DOCUMENTS

| | | | |
|---|---|---|---|
| 1,859,072 | 5/1932 | Christman . | |
| 1,906,879 | 5/1933 | Christman . | |
| 1,945,730 | 2/1934 | Christman . | |
| 3,114,166 | 12/1963 | Kurschner . | |
| 3,309,129 | 3/1965 | Newman | 428/31 |
| 3,341,879 | 9/1967 | Kumpman . | |
| 3,352,283 | 11/1967 | Maus . | |
| 3,401,418 | 9/1968 | Deck et al. . | |
| 3,448,722 | 6/1969 | Krizman . | |
| 3,695,222 | 10/1972 | Arrant . | |
| 3,722,019 | 3/1973 | Magnien . | |
| 3,930,278 | 1/1976 | Nasca . | |
| 4,260,655 | 4/1981 | Zoller | 428/31 |
| 4,334,706 | 6/1982 | Seki | 428/31 |
| 4,360,549 | 11/1982 | Ozawa et al. | 428/31 |
| 4,705,418 | 10/1987 | Van Wesenbeek . | |
| 4,726,614 | 2/1988 | Myers et al. | 293/1 |
| 4,778,550 | 10/1988 | Barton et al. | 423/31 |
| 4,946,727 | 8/1990 | Kessler | 428/31 |

FOREIGN PATENT DOCUMENTS

| | | | |
|---|---|---|---|
| 1232040 | 9/1989 | Japan | 428/31 |
| 2200870 | 8/1988 | United Kingdom | 428/101 |

OTHER PUBLICATIONS

Harley Davidson, Inc., Accessory Guide, 99456-90V, p. 91 Harley Davidson, Inc. (publication date unavailable).

*Primary Examiner*—Richard V. Fisher
*Assistant Examiner*—Brenda Lamb
*Attorney, Agent, or Firm*—Jerry A. Miller

[57] ABSTRACT

A pinstripe painting guide is fabricated by attaching a magnetic flexible guide rail to a hollow flexible support member by mating a channel to a T-shaped male mating member. This assembly is then attached to a surface to be painted and adjusted to provide an appropriate contour. The ends of the hollow support member are then plugged and the hollow support member is then flooded with a hardenable liquid such as fiberglass resin. When the liquid cures, the resulting tool is rigid and can be used for repeated application of similar pinstripes to the same type of surface. This process, for example, can be used to produce such a guide assembly for a particular model of automobile.

33 Claims, 3 Drawing Sheets

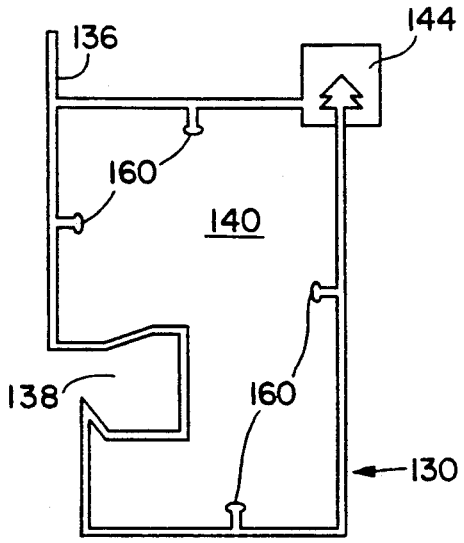
FIG. 6
FIG. 5
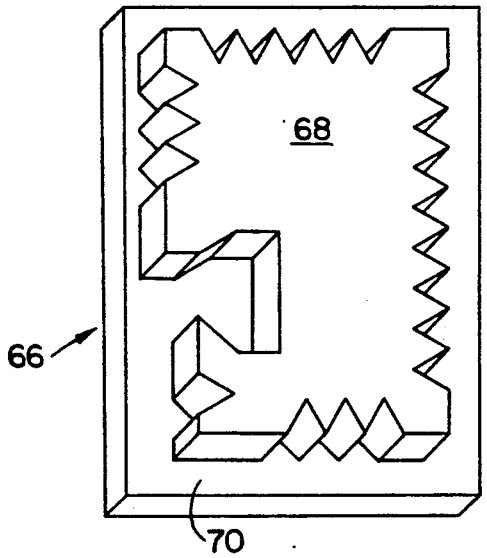
FIG. 4
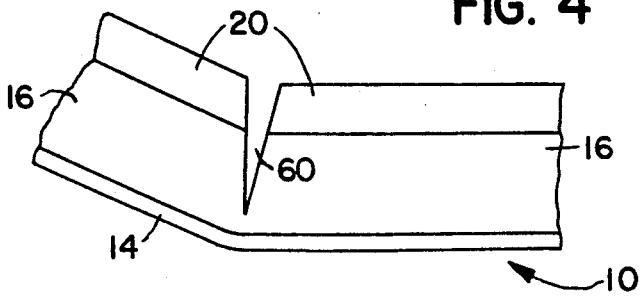

PINSTRIPE PAINTING GUIDE AND METHOD OF USE

CROSS REFERENCE TO RELATED DOCUMENTS

This invention was initially disclosed in disclosure document number 193,013 filed May 13, 1988 and disclosure document number 219,808 filed Feb. 13, 1989. These disclosure documents are hereby incorporated by reference herein.

BACKGROUND

1. Field of the Invention

This invention relates generally to the field of pinstripe painting. More particularly, this invention relates to a pinstripe painting guide particularly useful for painting pinstripes on automobiles and a method for manufacturing such pinstripe painting guides. The guides are light and easily manufactured, and they can be used to inexpensively make a mold for mass production.

2. Background of the Invention

Painting guides are described in several U.S. Patents. In U.S. Pat. No. 3,448,722 to Krizman, a painting guide useful for providing pinstripes on automobiles and the like is described. In this patent, a magnetic strip includes a track which guides a roller for application of the paint. This magnetic strip can be attached to the side of the surface being painted and flexed into conformity with the curves of the surface. The this magnetic strip is flexible enough to assure that the guide can be adjusted to provide a straight or curved pinstripe as desired.

Unfortunately, although this guide mechanism, with certain limitations, works quite well, it requires a substantial setup time since the magnetic strip bearing the guide track tends to deform somewhat. The long lengths required to pinstripe a typical automobile tend to become disfigured while being handled, applied or removed from the surface and must therefore be applied with great care. Every inch of the guide must be carefully aligned and straightened by bending so that the resulting pinstripe will be of the proper shape and will not be wavy or misaligned with the automobile's features. This adjustment process must be repeated each time the guide is used and can take up to several hours to obtain proper adjustment, depending upon the automobile, the contour being painted, the quality level required and the care of the painter. Also, some sharper curves are not attainable with Krizman's system because the magnetic strip attempts to maintain a straight shape and the extrusion memory overcomes the magnet's ability to stay in place and it will fall from the car. For example, sharp curves extending from a side of a car to a back of a car cannot be readily achieved with this system.

In automobile factories, pinstriping is done with an elaborate rigid guide which is also tedious to adjust initially, but once adjusted for a particular model of automobile, can be used repeatedly. Unfortunately, such guides are both costly and too heavy and bulky for use by a typical painting shop, auto dealer or other aftermarket pinstripe painter.

The present invention ameliorates these problems by providing an improved paint guide which, once fabricated, retains its shape for use in similar car models without significant adjustment. It is small and light enough to be readily stored and handled by a lone worker and can be inexpensively fabricated. It is, thus, much more suitable for use in aftermarket applications than those of the prior art.

The paint applicator used in U.S. Pat. No. 3,448,722 is similar to those also disclosed in U.S. Pat. Nos. 1,859,072 and 1,945,730 and is the type for which the present invention is specifically designed. These patents are hereby incorporated by reference.

SUMMARY OF THE INVENTION

It is an object of the present invention to provide an improved pinstripe painting guide It is another object of the present invention to provide a method for fabricating a painting guide which can be custom designed on the spot for virtually any make of automobile.

It is a further object of the present invention to provide an inexpensive pinstripe painting guide which, once fabricated, can be repeatedly used without long setup times.

It is an advantage of the invention that repeat setup time is minimal.

These and other objects and advantages of the invention will become apparent to those skilled in the art upon consideration of the following description of the invention.

According to the present invention, a pinstripe painting guide is fabricated by attaching a magnetic flexible guide rail to a hollow flexible support member by mating a channel to a T-shaped male mating member. This assembly is then attached to a surface to be painted and adjusted to provide an appropriate contour. The ends of the hollow support member are then plugged and the hollow support member is then flooded with a hardenable liquid such as fiberglass resin. When the liquid cures, the resulting tool is rigid and can be used for repeated application of similar pinstripes to the same type of surface. This process, for example, can be used to produce such a guide assembly for a particular model of automobile.

In one embodiment of the present invention, a method for manufacturing a pinstripe painting guide, includes the steps of: cutting a hollow flexible support tube and a flexible guide rail to an appropriate length for the stripe to be painted; mating the hollow flexible support tube to the guide rail to produce a mated assembly; attaching the mated assembly to a surface to be painted; flooding the hollow flexible support tube with a hardenable liquid; and curing the liquid to a hardened state.

Another method for manufacturing a pinstripe painting guide, includes the steps of: cutting a hollow flexible support tube and a flexible guide rail to an appropriate length for the stripe to be painted; mating the hollow flexible support tube to the guide rail to produce a mated assembly; attaching the mated assembly to a surface to be painted; plugging ends of the hollow flexible support tube; inserting a rigid support member inside the hollow flexible support tube; adjusting the position of the mated assembly to position the guide in a desired location; flooding the hollow flexible support tube with a mixture of fiberglass resin and hardener in liquid form by pouring the liquid through an opening in a top of the hollow flexible support tube and closing the opening; and curing the liquid to a hardened state.

pinstripe painting guide according to the present invention, includes a flexible guide rail having a guide edge. A tubular flexible support member is mated to the guide rail. The assembly is stiffened thus rendering the flexible support member rigid.

A method according to the present invention for manufacturing a pinstripe painting guide, include the steps of: providing a hollow guide at an appropriate length for the stripe to be painted; attaching the guide to a surface to be painted; flooding the hollow guide with a hardenable liquid; and curing the liquid to a hardened state.

A pinstripe painting guide according to the present invention includes a flexible guide rail having a hollow cavity and having a guide edge. A stiffener for renders the flexible guide rail rigid.

The features of the invention believed to be novel are set forth with particularity in the appended claims. The invention itself, however, both as to organization and method of operation, together with further objects and advantages thereof, may be best understood by reference to the following description taken in conjunction with the accompanying drawing.

BRIEF DESCRIPTION OF THE DRAWING

FIG. 4 shows the guide member of FIG. 1 with a V-shaped section removed to bend a tight curve.

FIG. 5 shows an end plug for the support tube shown in FIG. 2.

FIG. 6 shows an alternative embodiment of the support tube of the present invention.

DETAILED DESCRIPTION OF THE INVENTION

Figure 1:
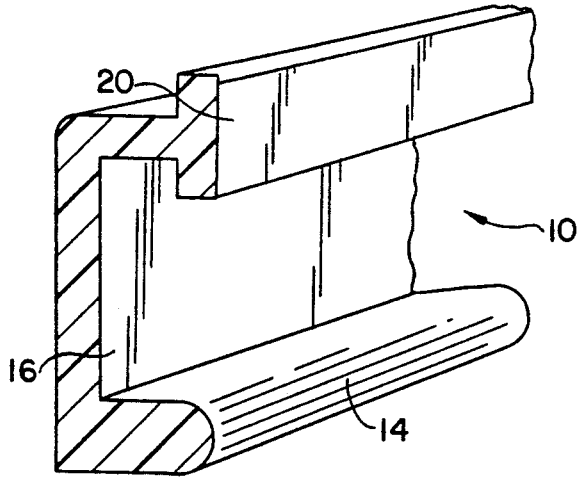
FIG. 1 shows an extruded flexible magnetic guide member forming a part of the present invention.

Turning now to the drawing in which like reference numerals designate corresponding parts throughout the several figures thereof, and in particular to FIG. 1, a first part of the present invention is shown. FIG. 1 shows a guide rail 10 which is preferably made by extrusion of a flexible magnetic material. The guide rail 10 includes a lower edge 12 which can be used as a guide for several commercially available pinstripe painting tools by simply running the tool along this edge to register the painting tip with a line defined by the guide.

Adjacent the guide edge is a track 14 which is simply a rounded over rail extending from the body portion 16 and extending along the length of the guide rail 10. This track 14 is used much the same way as the track on the previously described Krizman patent. Namely, one or more rollers are provided on a striping tool which engage the track 14 to guide the tool along a path defined by the track 14.

In other embodiments of the invention, the track 14 may take on other shapes to accommodate the particular type of pinstripe painting tool to be used. For example, the preferred shape as shown can also be used with the tools shown in U.S. Pat. No. 1,859,072 or 1,945,730. With other tools, the preferred track shape may actually be more like a shelf which the pinstripe painting tool either slides or rolls against. These and other variations will be evident to those skilled in the art.

Figure 2:
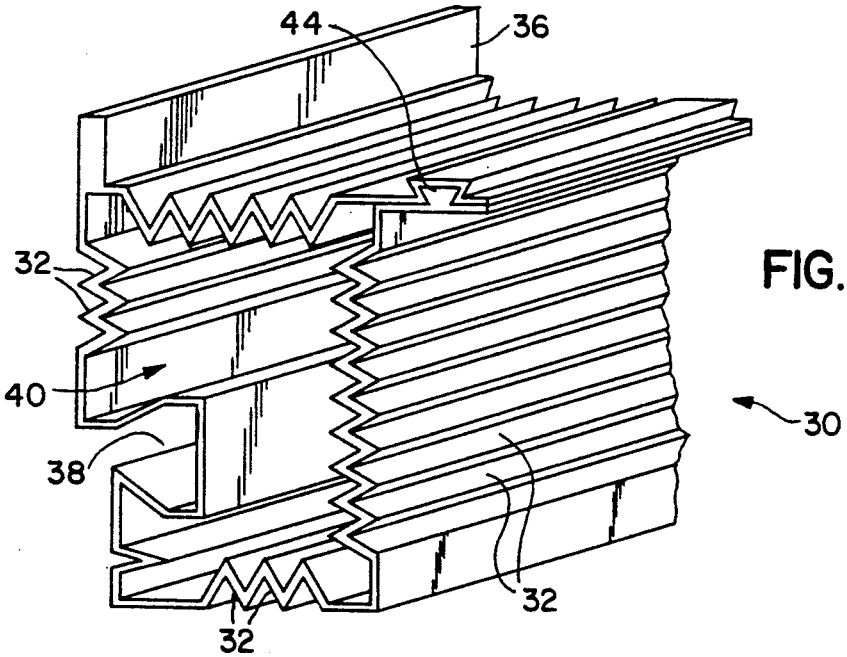
FIG. 2 shows a flexible support tube forming a part of the present invention.

At the top of the body 16 is male engaging member 20 which is T-shaped in cross section to provide engagement with the structure of FIG. 2 as will become clear shortly. Guide rail 10 is preferably, but not necessarily, extruded from a flexible rubber or plastic material which is impregnated with iron magnetized so that when this material is placed in contact with a metal surface, it sticks to it. The guide rail 10 can be made to any suitable size as desired, but the following has been found satisfactory. The thickness of all parts except the track 14 can be approximately 2.0 mm. The height from top to bottom can be approximately 3.5 cm. The diameter of the curvature of the track can be approximately 5.0 mm. The overall thickness at the track 14 or at the T-shaped male engaging member 20 (front to back) can be approximately 1.0 cm. The magnetic properties for such a rail provide roughly on the order of ½ pound of pull per square inch of material.

Turning to FIG. 2, a hollow tubular flexible support member 30 is shown. This support member 30 is preferably, but not necessarily, extruded from flexible PVC plastic or similar material so as to be easily shaped into any desired contour. The walls may generally be approximately 1-2 mm thick in most locations, depending upon the flexibility of the material to be used. The support member can be approximately 5 cm tall and approximately 3 cm thick, but this is not to be limiting. The material should be easily shaped into any desired contour but should have enough rigidity to support the weight of the support filled with liquid when used as will be described.

The support member 30 includes, in the preferred implementation, a plurality of accordion folds 32 on the surfaces defining an inner cavity. These accordion folds 32 permit the support member 30 to be readily shaped to any desired contour useful in conforming to a typical automobile body without significant buckling of the material. A ledge 36 is provided along an upper rear corner to facilitate taping of the support member to an automobile body. This is sometimes desirable for automobile parts made of fiberglass resin, plastic or other non-metallic materials (or simply when further strength of attachment to the automobile body is desired).

A female channel 38 is formed along the length of the support member 30 which is used to engage the T-shaped male engaging member 20 of guide rail 10. Due to the flexibility of the material involved, the parts can simply be snapped into engagement by flexing the support member 30 to open the channel and then inserting member 20 into the channel.

In order to provide the support function, support member 30 has a tubular construction with a cavity 40 defined by its walls. This cavity 40 is flooded, as will be described later, with a hardenable liquid such as fiberglass resin, epoxy etc., to provide rigid support for the guide rail 10. In one embodiment as shown, the upper portion of the support member 30 can be opened to permit filling of this cavity 40 with hardenable liquid. This is accomplished by provision of a latching mechanism 44 at the junction of the upper and outer edges. This latching mechanism 44 may function similar to the latching mechanism found on plastic storage bags or the like by providing mating dovetail structures which can be snapped together to seal the opening. Other structures will also occur to those skilled in the art.

In other embodiments, such a latching mechanism may not be needed. In such embodiments, the liquid may be injected through the walls of the support member using a syringe or the like. Or, slits may be made in the top of the support member to receive the liquid or the liquid may be forced through the ends of the support member 30. Any other suitable method for getting the hardenable liquid inside the support member may be used.

Figure 3:
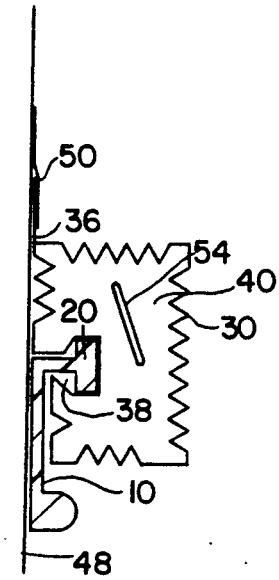
FIG. 3 shows the support tube mated together with the guide member attached to a surface to be painted.

Turning now to FIG. 3, a sectional view of the guide rail 10 mated with the support member 30 is shown attached to a surface 48 to be painted. In this figure, the male engaging member is shown engaged in the female channel 38. The ledge 36 is attached to surface 48 with tape 50 as previously described. Also shown is a flat metal rod 54 which is inserted into the cavity 40 and suspended by the hardened liquid to provide additional support.

When applying the guide to an automobile, it might be necessary to turn a sharper curve than can be readily absorbed by the flexibility of the magnetic guide rail 10. This material can often only be bent several degrees per inch so that sharp turns either cause the material to buckle or break. When such is the case, one or more V-shaped cuts 60 can be made in the guide rail 10 as shown in FIG. 4 to enable a greater range of movement of the guide rail 10. Similarly, one or more simple straight cuts can be made in the same position to enable bending of the material in the downward direction. To provide bends outward or inward, similar slices can be made from front to back and/or sections removed to provide relief for inward and outward bends. Afterward rough checking to see that adequate curvature can be obtained after making the cuts, the support member 30 can be attached.

Prior to flooding the cavity 40 with hardenable liquid, the ends should generally be closed off. This can be accomplished in a number of suitable ways. In FIG. 5, an end cap 66 is shown which can be used for this purpose. The end cap 66 has a raised area 68 which is made to conform to the shape of the cavity 40 of the support member 30 and seal by either application of a sealant or by an interference fit. The end cap's rim 70 is desirable, but not necessary, to help assure that the cap 66 is inserted squarely and not tilted. Those skilled in the art will appreciate that many other arrangements for end caps can be provided.

It will also be clear that the end of the cavity can be closed off by any number of other suitable methods. For example, by providing an extra length of the support member 30 extending beyond the necessary length to support guide rail 10, the end can simply be clamped, stapled, tied or taped shut. Or, the ends can be separately sealed by filling with RTV silicone and/or cotton or paper wadding or other material suitable for closure. Any excess length can be cut off after the hardenable liquid has cured.

Turning now to FIG. 6, an alternative embodiment of the support member is shown as 130. Many such alternatives will occur to those skill in the art. In this embodiment, the accordion folds are omitted and thus would likely have less flexibility than the previous embodiment, all other factors being equal. A similar ledge 136 and female channel 138 is provided for purposes similar to those explained above for ledge 36 and channel 38. The illustrated latching mechanism 144 provides a dual mating dovetail arrangement which functions similarly to that previously described as 44. The cavity 140 may be similarly flooded with a hardenable material and the walls include a plurality of anchors 160 which, when surrounded by the hardened liquid, serve to securely hold the walls to the hardened liquid. This feature can similarly be provided in the previously disclosed embodiment by simply extruding similar structures 160 on the interior of the accordion shaped member shown in FIG. 2.

Those skilled in the art will note that when the hardenable liquid is flooded into the cavity, the female channel 38 (or 138) becomes surrounded by the liquid. When the liquid hardens, the mated interconnection of the guide rail 10 and the support member 30 (or 130) becomes substantially permanent since the T-shaped male member 20 does not likely have adequate ability to compress to enable its release and since, the length of the assembly will likely contain curves which will serve to prevent disengagement by sliding.

Although the preferred embodiment uses the technique of flooding a cavity with a hardenable material to achieve the desired rigidity, equivalent techniques may also be used. For example, some materials can be transformed from a pliable material to a rigid material by exposure to heat, ultraviolet rays or solvents. Such materials may be used advantageously in an equivalent embodiment where such mechanisms are used to achieve the desired rigidity. Similarly, while the above structure is a two part structure with a guide and a support, the equivalent function may be achievable with a single part or may be fabricated from more than two basic parts without departing from the present invention.

Figure 7:
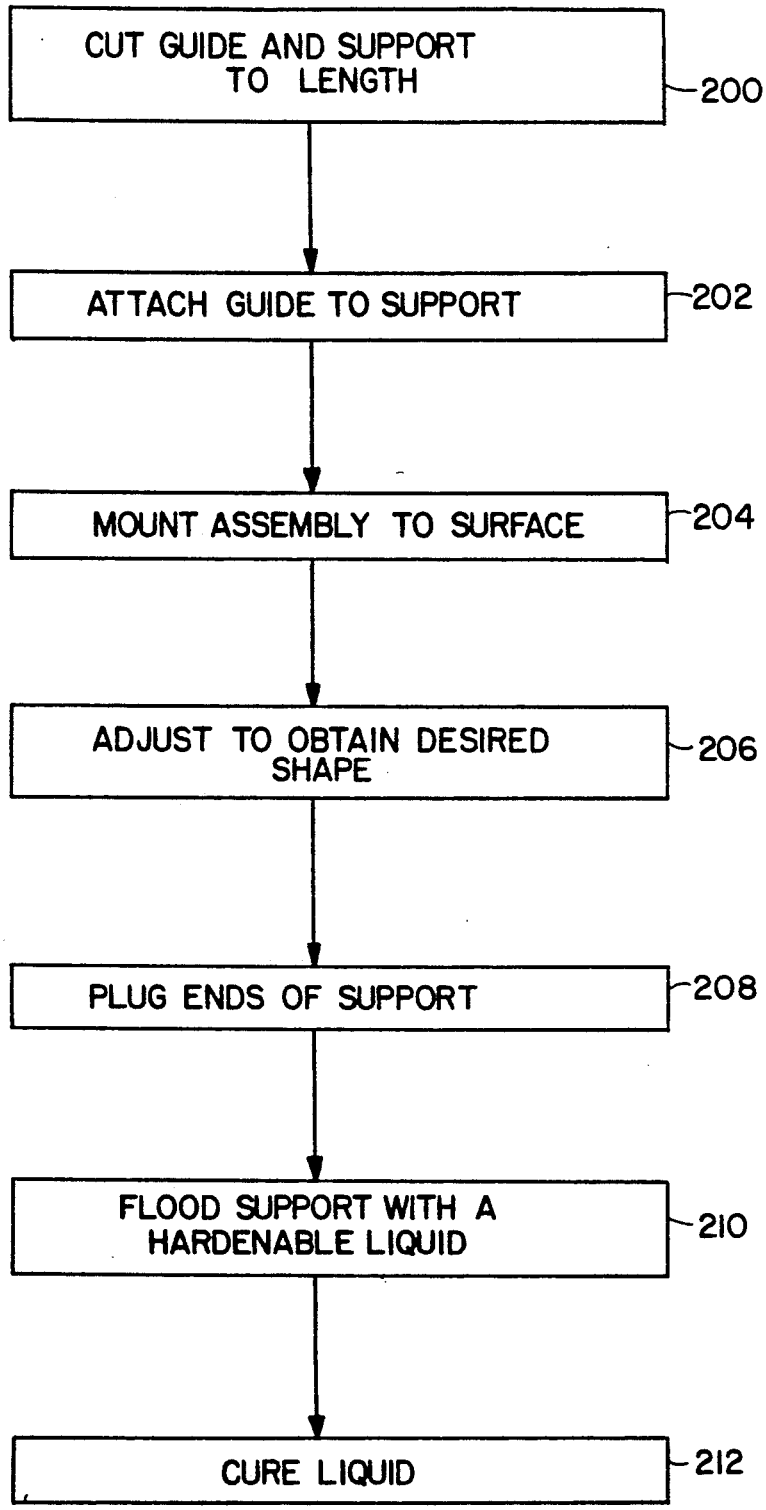
FIG. 7 is a flow chart of the process of manufacturing a pinstripe painting guide according to the present invention.

Turning now to FIG. 7, the process for fabricating the pinstripe painting guide of the present invention is shown in flow chart form. The first step in the process is step 200 wherein the guide rail 10 and support member 30 are cut to length. The guide rail 10 and the support member 30 are then mated together at 202. The mated assembly of the support member 30 and the guide rail 10 is then mounted at 204 to the surface to be painted using available reference points to guide the placement. Either magnetic attraction of the guide rail 10 to the surface to be painted or taping the ledge 36 to the surface or a combination holds it in place. Other connection techniques such as vacuum could also be used.

The shape of the assembly is then adjusted at 206 so that the desired contour is obtained for the pinstripe to be applied adjacent the track 14. This may require lifting and repositioning the tape if used as well as bending the support 30 and guide rail 10 or possibly cutting the guide rail 10 with slits or V-shaped cuts to permit the desired curvature. The assembly should preferably be secured in place by tape at the ledge 36 after final positioning to assure that there will be no sagging when flooded with liquid.

The ends of the support 30 are plugged or otherwise closed at 208 and the support is flooded with a hardenable liquid such as fiberglass resin at 210. The liquid can be injected with a device similar in construction to a meat baster syringe or simply poured in or otherwise injected in. The top is then closed and sealed if required. The liquid is then cured to form a rigid assembly. If desired, a rod or wire or flat metal support can be inserted into the cavity prior to filling with liquid to add further to the strength if the shape desired permits such an addition.

Those skilled in the art will appreciate that the exact order of steps recited above is not critical since the order of several steps can be interchanged without departing from the present invention.

Once the liquid has hardened and the guide thus rigidified, the surface can be painted with an appropriate pinstripe painting tool. The tool can then be removed. Once hardened, the tool can be used as a rigid guide which is custom tailored to the particular model of automobile from which it was formed. Thus, when another of the same model or style of automobile is to be painted, the process is simplified to that of attaching the rigid guide to the surface to be painted, aligning the rigid guide as desired and painting. This process will take only minutes compared with the tedious setup previously required with flexible guides. When fiberglass resin is used, the assembly is light enough to be positioned by a single worker and the cost of fabrication is much lower than that with a metal tool. Moreover, fabrication is practical at the typical paint shop or auto dealer.

In a variation of the invention, the track can be made to provide an inclined plane so that the roller of the paint applicator gradually withdraws from contact with the surface being painted. This provides a tapering of the pinstripe at the location of the incline. Also contemplated are guides made of a single part rather than the guide and support structure shown which might be fabricated using a single semi-rigid material or using a material which can be hardened or using more than one material which are molded together. The use of a single hollow magnetic extrusion may be advantageous in some instances, although it may be difficult and more costly to produce. Other variations will occur to those skilled in the art.

Also contemplated as part of this invention is that the track shape which is made rigid can be used as a pattern to manufacture a plurality of similar tracks by other manufacturing methods such as injection molding, metal stamping and the like. These reproductions of the pattern are derivatives thereof and considered a part of this invention.

It may also be advantageous in some embodiments to provide the hollow portion of the support with an initial lining or packing of fiberglass cloth or fibers to provide further strength to the assembly when hardened. The hardenable liquid may then be blown or injected into the hollow cavity which is prepacked with fiberglass fabric or the like. This has the further advantage of reducing the amount of resin needed.

While the present invention has been disclosed in conjunction with a particular embodiment, many variations are possible within the scope of the present invention. For example, although the preferred embodiment uses a guide rail and a support member which are initially fabricated separately, those skilled in the art will appreciate that a unitary guide which is initially flexible, but may be rendered rigid may also be used. Other variations will occur to those skilled in the art.

Thus it is apparent that in accordance with the present invention, an improved apparatus and method that fully satisfies the objectives, aims and advantages is set forth above. While the invention has been described in conjunction with specific embodiments, it is evident that many alternatives, variations, modifications and permutations will become apparent to those skilled in the art in light of the foregoing description. Accordingly, it is intended that the present invention embrace all such alternatives, variations, modifications and permutations as fall within the spirit and broad scope of the appended claims.

What is claimed as new and desired to be secured by Letters Patent is:

1. A pinstripe painting guide for use in conjunction with a paint applicator, comprising in combination:

a flexible guide rail having length and having a guide edge for guiding said paint applicator along said length;

a flexible support member;

mating means for mating said guide rail and said support member to produce a mated assembly; and stiffening means, comprising a body of hardened liquid which is flooded within a hollow portion of said flexible support member while in a liquid state and then hardened, for rendering said flexible support member substantially rigid and inflexible to provide a consistent profile along said length.

2. The pinstripe painting guide of claim 1, wherein said mating means comprises a channel in said flexible support member and an interlocking male member on said flexible guide rail suitable for engaging said channel.

3. The pinstripe painting guide of claim 2, wherein said interlocking male member is approximately T-shaped.

4. The pinstripe painting guide of claim 2, wherein said stiffening means renders said male member substantially permanently engaged within said channel.

5. The pinstripe painting guide of claim 1, wherein said stiffening means further comprises a reinforcing member suspended within said hardened liquid.

6. The pinstripe painting guide of claim 1, wherein said flexible support member includes closing means for selectively providing access to said hollow portion inside said flexible support member to flood said inside with a hardenable liquid.

7. The pinstripe painting guide of claim 1, wherein said flexible support member further comprises means for plugging an open end of said hollow portion of said flexible support member.

8. The pinstripe painting guide of claim 1, wherein said flexible support member includes a taping ledge extending along said length thereof, said taping ledge providing a surface suitable for affixing said flexible support member with adhesive tape to a surface to be painted.

9. The pinstripe painting guide of claim 1, wherein said flexible guide rail is made of a magnetic material.

10. The pinstripe painting guide of claim 1, wherein said flexible support member has a wall defining said hollow portion and wherein said wall includes a plurality of accordion folds.

11. The pinstripe painting guide of claim 1, further comprising a track adjacent said guide edge.

12. The pinstripe painting guide of claim 1, further comprising attaching means for attaching said mated assembly to a surface to be painted.

13. The pinstripe painting guide of claim 1, wherein said flexible support member has a tubular cross section.

14. A pinstripe painting guide for use in conjunction with a paint applicator to paint pinstripes on automobiles, comprising in combination:

a flexible guide rail means having length, having a hollow cavity, and having an exposed guide edge suitable for guiding said paint applicator; and stiffening means for rendering said flexible guide rail means sufficiently rigid and inflexible so that said guide edge provides a consistent profile along its length, said stiffening means comprising a hardened liquid filling said hollow cavity.

15. The pinstripe painting guide of claim 14, further comprising means for attaching said flexible guide rail means to a surface to be painted.

16. A pinstripe painting guide, comprising in combination:

a flexible guide rail means having a guide edge;

stiffening means for rendering said flexible guide rail means rigid;

said flexible guide rail means further including a hollow cavity; and said stiffening means comprising a hardened liquid filling said hollow cavity.

17. A pinstripe painting guide for use in conjunction with a paint applicator, comprising in combination:

a flexible guide rail having length and having a guide edge for guiding said paint applicator along said length, and having a hollow portion;

a flexible support member;

mating means for mating said guide rail and said support member to produce a mated assembly;

means for attaching said mated assembly to a surface to be painted, said surface having a contour; and stiffening means for rendering said flexible support member substantially rigid and inflexible to provide a consistent profile along said length, said stiffening means comprising a body of hardened liquid disposed within said hollow portion while in a liquid state and hardened to retain the contour of said surface to be painted.

18. The pinstripe painting guide of claim 17, further comprising a track adjacent said guide edge and said track includes an inclined surface for altering the height of said track relative to said surface to be painted.

19. A pinstripe painting guide for use in conjunction with a paint applicator, comprising in combination:

a flexible guide rail having length and having a guide edge for guiding said paint applicator along said length;

a flexible support member;

mating means for mating said guide rail and said support member to produce a mated assembly, said mating means comprising a channel in said flexible support member and an interlocking male member on said flexible guide rail suitable for engaging said channel; and stiffening means for rendering said flexible support member substantially rigid and inflexible to provide a consistent profile along said length and for rendering said male member substantially permanently engaged within said channel.

20. The pinstripe painting guide of claim 19, wherein said interlocking male member is approximately T-shaped.

21. The pinstripe painting guide of claim 19, wherein said flexible support member includes closing means for selectively providing access to a hollow portion inside said flexible support member to flood said inside with a hardenable liquid.

22. The pinstripe painting guide of claim 19, wherein said flexible support member includes a hollow portion, and further comprising means for plugging an open end of said hollow portion of said flexible support member.

23. The pinstripe painting guide of claim 19, wherein said flexible support member includes a taping ledge extending along said length thereof, said taping ledge providing a surface suitable for affixing said flexible support member with adhesive tape to a surface to be painted.

24. The pinstripe painting guide of claim 19, wherein said flexible guide rail is made of a magnetic material.

25. The pinstripe painting guide of claim 19, wherein said flexible support member has a wall defining a hollow portion and wherein said wall includes a plurality of accordion folds.

26. The pinstripe painting guide of claim 19, further comprising a track adjacent said guide edge.

27. The pinstripe painting guide of claim 19, wherein said track includes an inclined surface for altering the height of said track.

28. The pinstripe painting guide of claim 19, further comprising attaching means for attaching said mated assembly to a surface to be painted.

29. The pinstripe painting guide of claim 19, wherein said flexible guide rail means further includes a hollow cavity and said stiffening means comprises a hardened liquid filling said hollow cavity.

30. A method for using a pinstripe painting guide for applying pinstripes to a surface, comprising the steps of:

providing a paint applicator;

providing a flexible guide means having length and having a guide edge for guiding said paint applicator along said length;

attaching said flexible guide means to said surface;

stiffening said flexible guide means to render said guide means substantially rigid and inflexible so that said guide edge provides a consistent profile along its length, the stiffening step including flooding a hollow cavity of the guide means with a hardenable liquid and hardening the liquid within the cavity; and applying paint to said surface by guiding said paint applicator along the length of said guide edge.

31. The method of claim 30, wherein said flexible guide means includes a magnet, and wherein said attaching step is carried out by applying said magnet to said surface.

32. The method of claim 30, wherein said flexible guide means includes a taping ledge, and wherein said attaching step is carried out by taping said taping ledge to said surface.

33. A method for using a pinstripe painting guide for applying pinstripes to a surface, comprising the steps of:

providing a paint applicator;

providing a flexible guide means having length and having a guide edge for guiding said paint applicator along said length, said guide means including a flexible guide rail and a flexible support member;

attaching said flexible guide rail to said surface;

mating said flexible support means to said flexible guide rail;

stiffening said flexible support means to render said guide means substantially rigid and to substantially permanently mate said guide rail and said support means; and applying paint to said surface by guiding said paint applicator along the length of said guide edge.

* * * * *